United States Patent [19]

Vandegrift et al.

[11] Patent Number: 4,839,133

[45] Date of Patent: Jun. 13, 1989

[54] TARGET AND METHOD FOR THE PRODUCTION OF FISSION PRODUCT MOLYBDENUM-99

[75] Inventors: George F. Vandegrift, Bolingbrook; Donald R. Vissers, Naperville; Simon L. Marshall, Woodridge; Ravi Varma, Hinsdale, all of Ill.

[73] Assignee: The United States of America as represented by the Department of Energy, Washington, D.C.

[21] Appl. No.: 112,158

[22] Filed: Oct. 26, 1987

[51] Int. Cl.[4] ..... G21G 1/02; C25C 3/34; C25D 3/54; C25D 5/46

[52] U.S. Cl. ..... 376/202; 204/1.5; 252/645; 376/186

[58] Field of Search ..... 204/1.5; 376/186, 202; 252/645

[56] References Cited

U.S. PATENT DOCUMENTS

| | | | |
|---|---|---|---|
| 3,799,883 | 3/1974 | Arino et al. | 252/645 |
| 3,940,318 | 2/1976 | Arino et al. | 204/1.5 |
| 4,284,472 | 8/1981 | Pomares et al. | 376/186 |
| 4,596,647 | 6/1986 | Miller et al. | 204/212 |
| 4,701,308 | 10/1987 | Koehly et al. | 423/2 |

OTHER PUBLICATIONS

Inman et al., "The Electrocrystallization of Chromium from Molten Salt LiCl-KCl at 450° C.", Proceedings of the Fourth Intern'l Symp. on Molten Salts, 163rd Electrochemical Society Meeting, May 1983, pp. 544–558.

Vandegrift et al., "Preliminary Investigations for the Technological Assessment of $^{99}$Mo Production from LEU Targets", presented at the 1986 International Meeting on Reduced Enrichment for Research and Test Reactors, Nov. 3–6, 1986.

Vandegrift et al., "Continuing Investigations For Technological Assessment of $^{99}$Mo Production from LEU Targets", Presented at the 1987 International Meeting of Reduced Enrichment for Research in in Test Reactors, Sep. 28–Oct. 2, 1987.

*Primary Examiner*—Edward A. Miller
*Assistant Examiner*—Virginia B. Caress
*Attorney, Agent, or Firm*—Hugh W. Glenn; Robert J. Fisher; Judson R. Hightower

[57] ABSTRACT

A target for the reduction of fission product Mo-99 is prepared from uranium of low U-235 enrichment by coating a structural support member with a preparatory coating of a substantially oxide-free substrate metal. Uranium metal is electrodeposited from a molten halide electrolytic bath onto a substrate metal. The electrodeposition is performed at a predetermined direct current rate or by using pulsed plating techniques which permit relaxation of accumulated uranium ion concentrations within the melt. Layers of as much as to 600 mg/cm$^2$ of uranium can be prepared to provide a sufficient density to produce acceptable concentrations of fission product Mo-99.

20 Claims, 2 Drawing Sheets

TARGET AND METHOD FOR THE PRODUCTION OF FISSION PRODUCT MOLYBDENUM-99

CONTRACTUAL ORIGIN OF THE INVENTION

The U.S. Government has rights in this invention pursuant to Contract No. W-31-109-ENG-38 between the U.S. Department of Energy and the University of Chicago.

BACKGROUND OF THE INVENTION

This invention relates to a target for the production of Mo-99 fission product and for a method of preparing the target. The radioisotope Mo-99 is useful in the medical sciences as a source of Tc-99m, a diagnostic tool. Tc-99m is well suited for radiometric scanning of internal organs due to its short half-life resulting in reduced radiation exposure in medical applications. Ordinarilly, the users of Tc-99m will maintain a supply of Mo-99 from which Tc-99m can be extracted as required.

Previously, Mo-99 sources have been prepared by separating fission product Mo-99 from irradiated uranium highly enriched targets or by the irradiation of naturally occuring molybdenum. In the later case, only a small fraction of the molybdenum is converted to radioisotope Mo-99 such that the specific activity of the source is very low.

Uranium targets, including uranium oxide, with a high enrichment of uranium 235, i.e. in excess of 90%, have been irradiated for the production of fission product Mo-99. High purity Mo-99 can be separated from the remaining fission products and transuranium elements by well established techniques. However, the uranium targets with high enrichment must be handled with extreme care under carefully regulated conditions with heavy restrictions on their distribution.

Representive techniques for the production of Mo-99 as a source of Tc-99 are described in U.S. Pat. No. 3,940,318 to Arino et al. and U.S. Pat. No. 3,799,883 to Arino et al. U.S. Pat. No. ('318) describes a target and process for irradiating highly enriched uranium for the production of Mo-99 fission product. The uranium target material is electrodeposited as uranium oxide from aqueous solution containing uranyl compounds onto a stainless steel substrate. The separation of Mo-99 from other fission products, residual uranium and transuranium products in described in U.S. Pat. No. ('883).

Although uranium metal along with transuranium elements have been electrorefined from molten salt mixtures (e.g. U.S. Pat. No. 4,596,647), considerable difficulties have been encountered in obtaining good bonding of uranium deposits to corrosion resistant substrates such as stainless steels and zirconium alloys. Futhermore, electroplated uranium metal has exhibited extensive dendrite formations which impair its suitability as a target material.

Therefore, in view of the above, it is an object of the present invention to provide an improved target for the production of Mo-99.

It is also an object to provide a uranium target with a low enrichment of uranium-235 for Mo-99 production.

It is a further object to provide an irradiation target which exhibits good bonding of low enriched uranium metal to a target substrate surface.

It is also an object of the present invention to provide a method for the deposition of uranium metal with a low enrichment of uranium-235 onto a substrate to form a well-bonded layer of dendrite-free uranium.

It is likewise an object of the present invention to provide a method of producing an irradiation target with sufficient uranium density to be compatable with current target and irradiation configurations for the production of the fission product, Mo-99.

SUMMARY OF THE INVENTION

In accordance with the present invention, a target for the production of fission product Mo-99 from uranium is provided. The target includes a structual support member with a preparatory coating of substrate metal. An electrodeposited layer of uranium metal that is substantially free of dendrite formation is bonded to the preparatory coating at least in part by the presence of intermetallic compounds of uranium and the substrate metal.

In other aspects of the target provided by this invention, the uranium 235 concentration in uranium 238 is no more than 20 weight percent but more than the naturally occuring concentration of uranium 235 in uranium 238. Uranium metal depositions of more than 50 milligrams per centimeter square are contemplated.

The preparatory layer is of a substantially oxide-free metal selected from iron, copper, nickel or alloys of these metals. Uranium intermetallic compounds such as $U_6Ni$, $U_6Fe$, UNi, $UNi_2$, $UFe_2$, $UNi_5$, UFeNi or $UCu_5$ or alloys can be formed at the interface to enhance uranium bonding. Preferably, the oxide-free preparatory layer is of nickel and the uranium intermetallic compounds are of uranium and nickel. Typically, an electroless plated nickel coating on a support substrate at the internal surface of a hollow cylinder or tube is selected as the target.

In other aspects of the invention, a method of preparing a neutron irradiation target for the production of Mo-99 as a source of Tc-99m is provided. A metal substrate having a substantially oxide-free surface is immersed in molten halide salt including a uranium halide enriched in uranium-235. The uranium metal is electrodeposited onto the substantially oxide-free surface in the form of uranium metal substantially free of oxides of uranium.

In further aspects of the method, electrodeposited uranium is irradiated by neutron flux to produce fission product Mo-99 which then is separated into substantially pure form for use as a source of radioactive technetium.

In preparing for the uranium electrodeposition, the metal substrate surface is anodized to transfer metal ions from its surface into the molten halide salt. On subsequent electroplating of uranium metal, intermetallic compounds of uranium and the substrate metal are formed. Preferably, an initial cathodic pulse substantially above that required to electrodeposit uranium metal is used to electrodeposit a nucleating layer that can include uranium intermetallic compounds or alloys.

The electrolyte for the electrodeposition of uranium is a molten halide salt selected from the alkali metal halides or the alkaline earth metal halides. Such salts include eutectics and other mixtures of LiCl, KCl, NaCl, $CaCl_2$ and $BaCl_2$. A eutectic composition of LiCl-KCl is a preferred choice.

Acceptable uranium deposits can be formed on the selected substrate at a current density sufficiently low to minimize or prevent dendrite formations. The inventors have found that a current density of about 10 $mA/cm^2$ provides uranium deposits with excellent bonding for use as targets for MO-99 reduction.

In one other manner of performing the method of the present invention. Uranium metal is electrodeposited by applying a series of cathodic pulses, each followed by a relaxation period of substantially longer time than the cathodic pulse width. In one other aspect of the method, the cathodic pulses are alternated with anodic pulses at the substrate. The cathodic pulses are of greater absolute magnitude and width than that of the anodic pulses to provide a net electrodeposition of uranium metal.

BRIEF DESCRIPTION OF THE DRAWINGS

The present invention is described in the accompanying drawings wherein.

DETAILED DESCRIPTION

Figure 1:
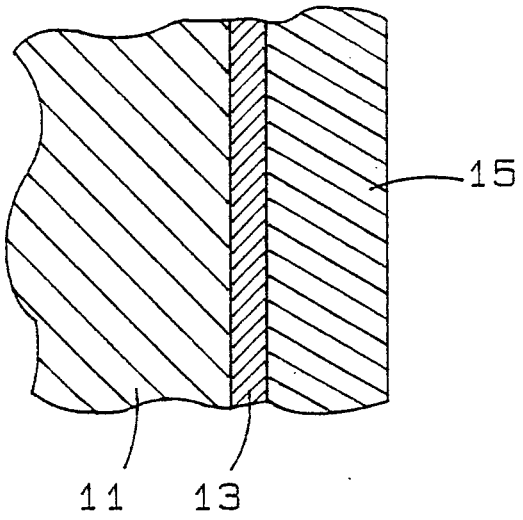
FIG. 1 is a fragmentary cross-sectional illustration of electrodeposited uranium metal on a substrate.

In FIG. 1 a support 11 is illustrated with a preliminary coating of a preparatory metal 13 and a layer 15 of electrodeposited uranium enriched in uranium-235. The support material 11 for the target can be of any material compatable with the process conditions required for Mo-99 production. Typically, target supports of stainless steel or of zirconium alloys have been employed, however, materials such as nickel, nickel alloy, zirconium containing materials and zinc-coated materials can be considered for use. In one current target arrangement in which Mo-99 is produced from highly enriched uranium, the support is fabricated in the form of a hollow cylinder or tube with the uranium deposits at the internal cylindrical surface.

In the present invention, a preparatory layer 13 of substantially oxide-free metal is placed on the support surface to obtain a well bonded uranium deposit. Support materials such as stainless steel and zircaloy will include oxides such as chromium oxide and oxides of zirconium within their outer surfaces to limit their suitability as a direct substrate for electrodeposition of uranium metal. Preparatory layer 13 can be of metal such as nickel, copper or iron or alloys of these materials. Preferably a corrosion resistant metal of nickel or copper is selected but with careful handling in an inert atmosphere to avoid oxidation, a preparatory substrate of iron may be suitable for use. The inventors have found that an oxide-free nickel coating is the best selection for good bonding of the electrodeposited uranium metal.

The target will contain a predetermined amount of electrodeposited uranium metal enriched in U-235. Although high levels of enrichment, up to and above 90% by weight U-235, can be used, the present method and target are designed to accomodate uranium of low enrichment that is unsuitable for diversion to other applications. To ensure against unauthorized diversions, the uranium enrichment is to be no more than 20 weight percent U-235 but of greater U-235 concentrations in U-238 than that of naturally occuring uranium. Consequently, the amount of uranium deposited on the target must be substantially greater than that of targets prepared with highly enriched uranium. The inventors have found that prior techniques involving the electrodeposition of uranium oxide are unsuitable for forming uranium deposits of more than 50 mg/cm$^2$. Low enrichment targets in accord with the present invention will employ more than 100 mg U/cm$^2$ and preferably targets of 400 to 700 mg U/cm$^2$ are selected. Such targets typically will have a deposit of about 0.1 to 0.3 mm thick uranium metal.

In fabricating the uranium targets, a thin film of the preparatory metal on the order of 20 to 50 microns thickness is electrodeposited or otherwise bonded to the support substrate. Where nickel is selected as the preparatory coating, commercially available electroless processes can be employed. For example, an electroless nickel plating process involving the reduction of nickel on a catalytic surface with a hypophosphite salt can be used.

The electrodeposition of the uranium metal is carried out in an inert gas environment with a molten halide salt used as an electrolyte. Molten alkali metal halides, alkaline earth metal halides or mixtures thereof are contemplated for use. Although either a fluoride or a chloride molten salt can be employed, chloride melts are preferred as they are less corrosive, less sensitive to moisture and can be operated at lower temperatures than the fluoride salts. Uranium can be incorporated into the salt as $UCl_3$ typically from the oxidation of uranium metal with $CdCl_2$. Many different chloride salts containing $UCl_3$ can be used, for instance, $BaCl_2$-$CaCl_2$-LiCl, $BaCl_2$-KCl-NaCl, $BaCl_2$-$CaCl_2$, LiCl-NaCl and LiCl-KCl. Based on economics and availability, LiCl-KCl is a preferred selection.

Good bonding of uranium metal onto nickel and copper substrates can be prepared by direct current plating or by pulse plating techniques. In the direct current plating method, current densities of less than 5 mA/cm$^2$ provide insufficiently dense electrodeposits and leave uncovered areas of substrate. With current densities above 20 mA/cm$^2$ substantial dendrites are formed in the uranium deposits. Uranium deposits formed at about 10 mA/cm$^2$ provide excellent bonding of uranium deposits that are substantially free of dendrites.

Table 1 below gives the plating conditions for the direct current uranium depositions.

TABLE 1

| D.C. Uranium Plating Conditions | | |
|---|---|---|
| Plating Time (hr) | Current Density (mA/cm$^2$) | Uranium (mg/cm$^2$) |
| 3.5 | 10 | 100 |
| 5.5 | 10 | 158 |
| 2.75 | 20 | 158 |
| 11.5 | 10 | 331 |
| 13.0 | 5 | 187 |

A preferred method of applying uranium deposits involve pulse plating to enhance quality. The inventors have found that by using short cathodic pulses followed by somewhat longer periods of relaxation that well bonded uranium deposits substantially free of dendrites can be formed on the preparatory substrate metals.

Advantageously, a nucleation pulse following a period of anodization can be employed to lay down an initial layer that can include intermetallic compounds or alloys of uranium and the preparatory substrate metal. The nucleation pulse is conducted at a potential well above that required to electrodeposit uranium to avoid segregation of the substrate metal from the uranium.

In an alternative pulse plating technique, cathodic pulses are followed by anodic pulses rather than a period of relaxation. The cathodic pulses must be of sufficiently greater absolute magnitude or pulse width than the anodic pulses to provide a net electrodeposition of uranium metal.

The following example is presented to illustrate a pulse plating technique for uranium deposits.

EXAMPLE

Figure 2:
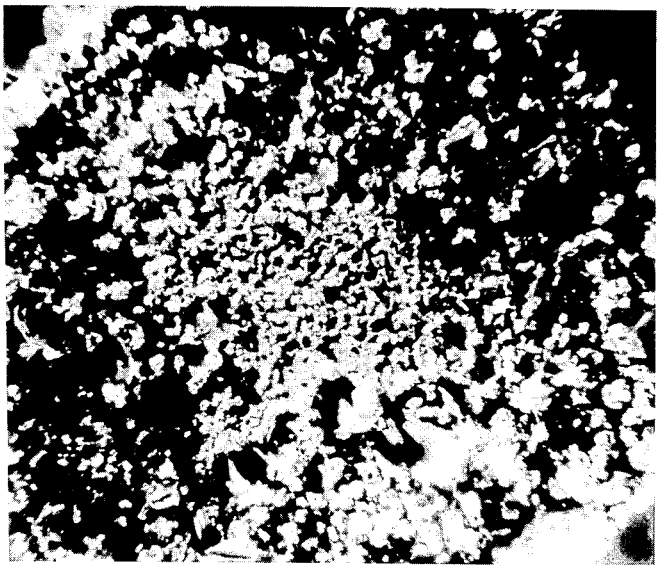
FIG. 2 is a photograph of a substantially dendrite-free uranium deposit on a nickel substrate.

A nickel substrate was cleaned and etched for 30 seconds in a reagent including 4 volume percent concentrated $HNO_3$ and ten volume percent acetic acid in water. The substrate was preanodized with five coulombs at 1.35 volts followed by a $-706$ mA/cm$^2$ nucleation pulse in an LiCl-KCl molten salt electrolyte. Uranium was electrodeposited over a 21 hour period of cycling between a pulse of $-65$ mV for about 0.1 mSEC followed by a zero potential pulse for 1 mSEC. A deposit of 0.15 mm (290 mg U/cm$^2$) film of uranium was formed. The electrodeposit was found to be substantially free of dendrites and is illustrated in the FIG. 2 photograph.

Other successful electrodepositions of uranium on nickel substrates were made at plating voltages of $-75$ to $-175$ mV for intervals of up to 1 mSEC followed by relaxation periods of up to 10 mSEC. Voltage pulses greater than $-200$ mV began to produce dendrites within the uranium deposit. Uranium depositions of 0.1 to 0.4 mm are readily provided by the method of this invention.

Following irradiation of the target, to form Mo-99, the Mo-99 can be separated from the residual uranium, other fission products and other transuranium values by well known processes. For instance, the process of U.S. Pat. No. 3,799,883 can be employed and this patent is hereby incorporated by reference for this purpose.

Therefore, it is seen that the present invention provides a target for Mo-99 production and a method of its preparation. Uranium of either low or high enrichment in U-235 can be selected. Sufficiently dense targets of low enrichment uranium can be provided to be compatable with current target configurations, e.g. a hollow cylinder with uranium deposited at the internal cylindrical surface. The method permits deposition of thick uranium layers that are strongly bonded to the substrate and are substantially free of dendrite formations.

Although the present invention has been described in terms of a specific environment, it will be clear to one skilled in the art that various modifications can be made in the materials, structures and procedures within the scope of the accompanying claims.

We claim:

1. A target for the production of fission product Mo-99 from uranium comprising:

a structural support member, a preparatory coating of an oxide-free substrate metal selected from the group consisting of Ni, Cu, Fe and alloys thereof deposited on said support member; and an electrodeposited layer of oxide-free uranium metal on the preparatory coating, said uranium layer being free of dendrite formations.

2. The target of claim 1 wherein said uranium has an isotope concentration of U-235 in U-238 of no more than 20 w % but of more than the naturally occurring concentration of U-235 in U-238.

3. The target of claim 1 wherein said support member is of tubular shape having inner and outer cylindrical surfaces, said preparatory coating and electrodeposited uranium layer are on the inner cylindrical surface thereof.

4. The target of claim 1 including intermetallic compounds selected from the class of uranium intermetallic compounds consisting of $U_6Ni$, $U_6Fe$, UNi, $UNi_2$, $UFe_2$, $UNi_5$, UFeNi and $UCu_5$ at the interface of said preparatory coating and layer of uranium metal.

5. The target of claim 1 wherein said substantially oxide-free metal is selected from Cu and Ni.

6. The target of claim 5 including intermetallic compounds selected from the uranium intermetallic compounds consisting of $U_6Ni$, UNi, $UNi_2$, $UNi_5$ and $UCu_5$.

7. The target of claim 6 wherein said substantially oxide-free metal is nickel.

8. The target of claim 7 wherein said nickel is in the form of an electroless plated coating on the support member.

9. The target of claim 1 wherein said support member is of stainless steel or zircaloy.

10. The target of claim 1 wherein said layer of uranium metal is more than 100 mg/cm$^2$.

11. A method of providing a neutron irradiation target for the production of Mo-99 as a source of Tc-99m comprising:

providing a metal substrate having a substantially oxide-free surface said surface being of a metal selected from the group consisting of Ni, Cu, Fe and alloys thereof;

immersing said substrate surface in molten halide salt including a uranium halide enriched in U-235 and;

electrodepositing uranium metal enriched in U235 onto said substrate surface with a series of cathodic pulses, said electrodeposited uranium metal being substantially free of oxides of uranium.

12. The method of claim 11 wherein said metal substrate with electrodeposited uranium is irradiated with neutron flux to produce fission product Mo-99, other fission products and transuranium products and wherein said Mo-99 then is separated from said other fission products, residual uranium and transuranium products.

13. The method of claim 11 wherein prior to said electrodeposition step, said substrate surface is anodized to transfer metal ions from said surface into said molten halide salt.

14. The method of claim 11 wherein said metal substrate surface immersed in molten halide salt is anodized at a sufficient potential to transfer metal from the substrate surface to the molten halide salt and pulsed at a cathodic polarity substantially above that required to electrodeposit uranium metal to electrodeposit a nucleating layer including uranium intermetallic compounds of uranium and the substrate metal.

15. The method of claim 11 wherein said electrodeposition of uranium is performed by applying cathodic pulses to said substrate surface, said pulses each being followed by a relaxation period of substantially longer time than each cathodic pulse width.

16. The method of claim 11 wherein said electrodeposition of uranium metal is performed by cathodic pulses alternating with anodic pulses at said substrate, said cathodic pulses being of absolute magnitude and width greater than that of the anodic pulses to provide a net electrodeposition of uranium metal.

17. A method of preparing an irradiation target of uranium metal for molybdenum-99 production comprising:

depositing an oxide-free metal layer, selected from the group of metals consisting of Ni, Cu, Fe and alloys thereof, onto a support material;

contacting said metal substrate with a molten halide salt including a uranium halide within an inert gas environment;

electrodepositing uranium metal onto said oxide-free metal at a constant direct current of no more than 20 $mA/cm^2$ to form a dendrite-free uranium deposit.

18. The method of claim 17 wherein said uranium metal contains U-235 at an enriched level above that of naturally occurring uranium but of no more than 20% by weight U-235.

19. The method of claim 17 wherein said uranium metal is electrodeposited at a constant direct current of about 10 $mA/cm^2$ on said oxide-free metal layer.

20. The method of claim 17 wherein said oxide-free metal layer is deposited onto a support selected from the group of support materials consisting of stainless steel and zirconium alloys.

* * * * *